United States Patent [19]

Bello et al.

[11] 4,083,302

[45] Apr. 11, 1978

[54] CREDIT CARD VERIFICATION AND PRINTING DEVICE

[76] Inventors: Ralph R. Bello; Vera C. Bello, both of 35 Andrew La., Orange, Conn. 06477

[21] Appl. No.: 746,292

[22] Filed: Dec. 1, 1976

[51] Int. Cl.[2] ..... B41F 3/04

[52] U.S. Cl. ..... 101/269; 101/423; 101/425

[58] Field of Search ..... 101/45, 269, 354, 355, 101/423, 424, 425, 369

[56] References Cited

U.S. PATENT DOCUMENTS

| | | | |
|---|---|---|---|
| 1,616,556 | 2/1927 | Smith | 101/425 |
| 2,942,544 | 6/1960 | Williams | 101/269 |
| 3,374,733 | 3/1968 | Goodrich | 101/269 |
| 3,804,014 | 4/1974 | Thiene et al. | 101/269 |
| 3,828,667 | 8/1974 | Davis et al. | 101/354 X |
| 3,874,291 | 4/1975 | O'Reilly et al. | 101/269 |
| 3,890,899 | 6/1975 | Brvgge et al. | 101/269 |

FOREIGN PATENT DOCUMENTS

| | | | |
|---|---|---|---|
| 565,510 | 1/1924 | France | 101/424 |

*Primary Examiner*—Edward M. Coven
*Attorney, Agent, or Firm*—DeLio and Montgomery

[57] ABSTRACT

Apparatus for printing from a conventional embossed credit card and an embossed identification card having a picture, thumbprint and other embossed identifying indicia of the holder thereon. The apparatus includes an inker for inking the embossed indicia and a platen, both including carriages riding in a common track. In several modifications the apparatus includes means for cleaning the residual ink off the indicia after printing.

6 Claims, 9 Drawing Figures

CREDIT CARD VERIFICATION AND PRINTING DEVICE

BACKGROUND OF THE INVENTION

1. Field of the Invention

This invention relates generally to the field of printing devices and more particularly to credit card printers for recording identification indicia relating to the card user.

2. Description of the Prior Art

To facilitate the flow of commerce and to reduce the handling of cash, which can be lost or stolen, commercial enterprises, in particular retailing outlets which normally handle many commercial transactions each involving a small amount of cash, have encouraged the use of credit cards. Expanded use of such cards as a merchandising technique serves to reduce the amount of cash handled by the customer and by the store, and to encourage retail purchases by the consumer. As a result, however, credit cards have attained an intrinsic value and, because of imperfect monitoring, losses due to stolen credit cards and fraudulent purchases made therefrom extend to many thousands of dollars a year.

In an attempt to reduce this loss, credit card companies compile and disseminate lists of cards reported to them to have been stolen in the previous week or so; however, such lists normally take a considerable lead time to prepare and disseminate. Because very few of such cards have means for photographic identificaton of the user, ordinarily it is impossible to verify that the user is authorized to use the card. The salesman at the store usually has no way of immediately verifying the identify of the user or of recording a description of the user for identification purposes. It is desirable to have such a description recorded on the business form receipt used with the credit card so that if the card is fraudulently used, a description of the user is available on the receipt. Conventional credit card apparatus used heretofore does not provide sufficient clarity to allow for recording of embossed pictures or thumbprints from embossed identification cards, and hand recording of the information can lead to delay and lost sales.

SUMMARY OF THE INVENTION

It is therefore an object of the invention to provide a new and improved card imprinting and recording device capable of recording identifying indicia of the user.

It is another object of the invention to provide a printer for use with an embossed credit card and an embossed identification card having a picture of the user engraved thereon.

In brief, the invention provides a new and improved credit card printing or recording device for printing from a standard credit card and from an embossed identification card which may contain personal identifying data, such as a picture, a thumbprint and other identifying indicia, onto a business form. Apparatus is provided to first ink the embossed indicia on said card, said apparatus being drawn across a track over the cards. The business form is then laid face down over the inked cards. A platen supported by a carriage riding in the same track is forced over the business form causing the form to be printed on by the cards.

In several modifications, means are provided for cleaning the residual ink left on the cards after printing, comprising apparatus for dissolving the ink left on the cards and for wiping the dissolved ink therefrom.

BRIEF DESCRIPTION OF THE DRAWINGS

The aforementioned objects and features of the invention, as well as other objects and features thereof, will be better understood upon consideration of the following detailed description when read in conjunction with the drawings, in which.

DETAILED DESCRIPTION OF THE PREFERRED EMBODIMENTS

Figures 1, 2:
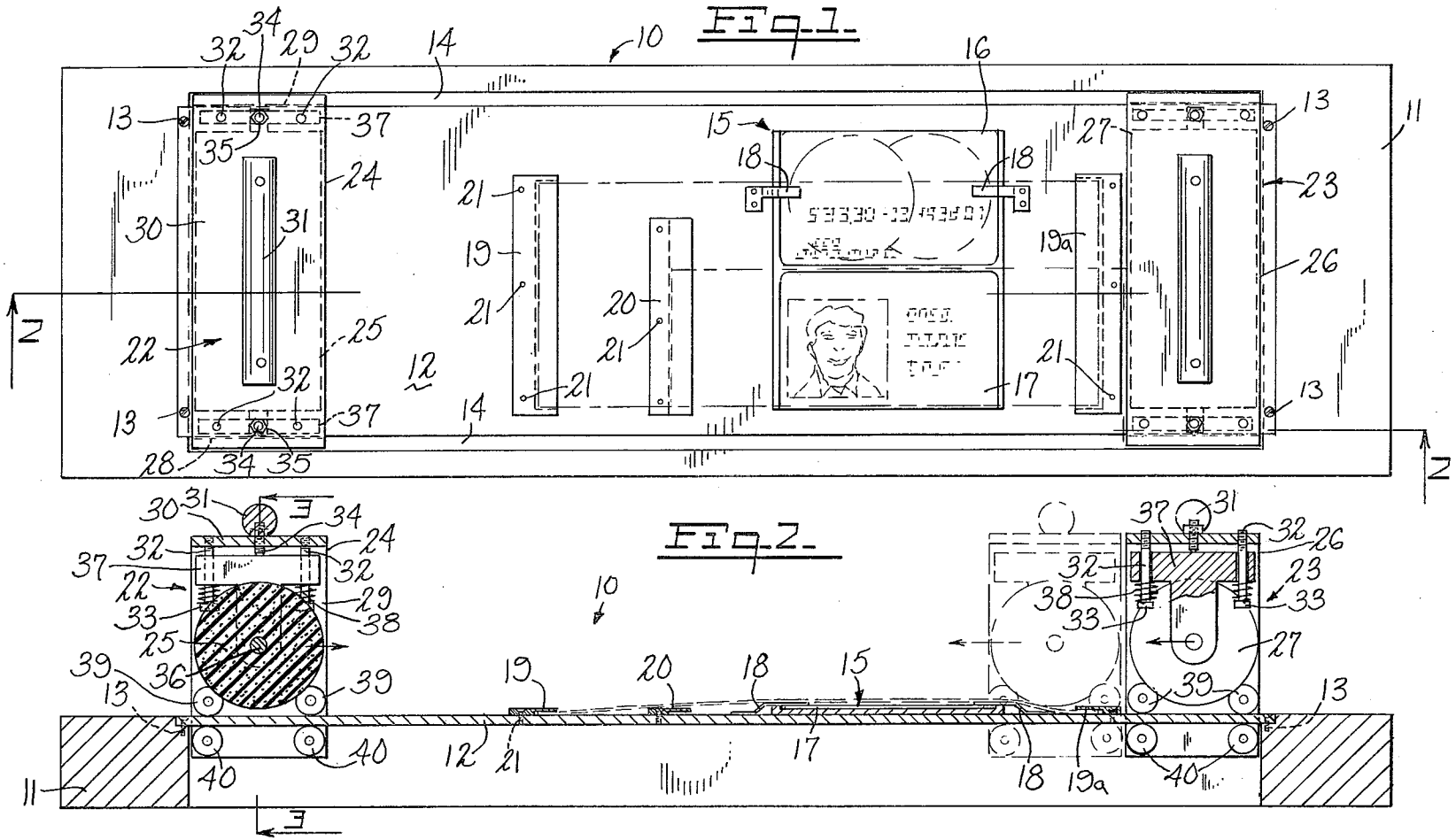
FIG. 1 is a top view of a printing apparatus employing the principles of the instant invention.
FIG. 2 is a front elevational sectional view taken along lines 2—2 in FIG. 1.

With reference to FIGS. 1 and 2, the invention provides a printer 10 including a support 11 and a base 12. Base 12 is attached to support 11 by means of four screws 13. A pair of slots 14 is formed between juxtaposed edges of base 12 and support 11 along the long dimension thereof. Base 12 further includes a card retainer 15 including two contiguous pockets 16 and 17. Pocket 16 is provided to receive a conventional embossed credit card, and pocket 17 is provided to receive an identification card having embossed indicia thereon such as a picture of the holder and other identifying indicia. The cards are shown in phantom lines in FIG. 1. Two retainer clips 18 project over pocket 16 to limit vertical movement of the credit card, the card being slipped under clips 18. Base 12 further supports two standard business form retainers 19 and **19*a* and a small business form retainer clip 20. Small business form retainer clip 20, in conjunction with standard business form retainer clip 19*a*, is provided to retain a business form suitable for recording only from the card disposed in pocket 17. Retainer clips 19, 19*a* and 20 are secured to base 12 by screws 21**.

Printer 10 further includes an inker 22 and a platen 23. Inker 22 comprises a carriage 24 which serves to rotatably support an inking roller 25. The carriage 24 slidably engages track 14 and transports inking roller 25 across retainer 15 to ink the cards placed therein. Inking roller 25 is preferably of a porous resilient material.

Platen 23 includes a carriage 26 rotatably supporting platen roller 27. The carriage 26 slidably engages slot 14 and transports platen roller 27 across base 12 and card retainer 15.

Figure 3:
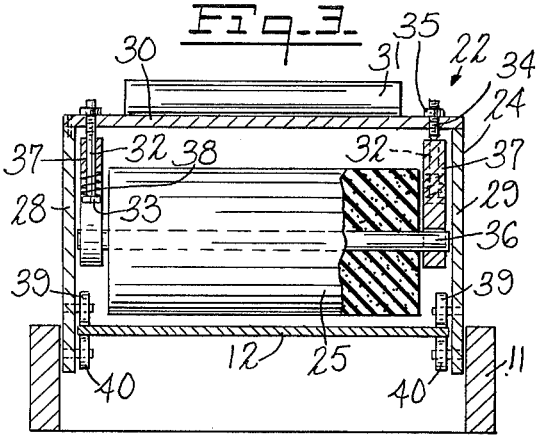
FIG. 3 is an end view partially in section taken along lines 3—3 in FIG. 2, showing a detail of a roller carriage.

With reference to FIGS. 2 and 3, carriage 24 (which has the same form as carriage 26) comprises two vertical members 28 and 29, one each engaging each slot 14. Carriage 24 further includes a horizontal member 30 across the top thereof. A handle 31 extends upwardly from the top of horizontal member 30. Horizontal member 30 has depending therefrom four vertical guide members 32, each having an enlarged head 33 at the lower end thereof. Horizontal member 30 also has depending therefrom a height adjustment screw 34 held in place by a locking nut 35.

Roller 25 is rotatably suspended from carriage 24 by an axle 36 engaging the vertically disposed arm of a T-shaped member 37. Each of the two ends of the horizontal cap of the T-shaped member 37 slidingly engages a guide member 32 and is pushed upwardly therealong by a spring 38 axially disposed about guide member 32 and abutting head 33. Spring 38 maintains the top of T-shaped member 37 tight against height adjustment screw 34.

Carriage 24 rides in and is guided by the tracks formed by slots 14. Vertical members 28 and 29 extend downwardly through respective slots 14. A pair of wheels 39 extending inwardly from respective vertical members 28 and 29 ride on base 12 and support carriage 24. Similarly, a pair of wheels 40 extending inwardly from each side engage the lower surface of base 12.

Figure 4:
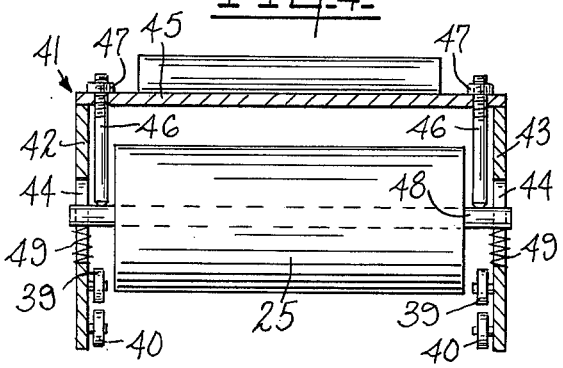
FIG. 4 shows a modification of the roller carriage shown in FIG. 3.

With reference to FIG. 4, a modified carriage 41 comprises two vertical members 42 and 43 each having a vertically elongated slot 44 near the center thereof. A horizontal member 45 extends between vertical members 42 and 43. Depending downwardly from horizontal member 45 are two height adjustment screws 46, each proximate respective vertical members 42 and 43. A lock nut 47 is provided for each height adjustment screw 46.

Modified carriage 41 further includes a roller 25 having an axle 48 extending through each of the two slots 44. A compression spring 49 disposed in each slot 44 forces the respective ends of axle 48 upwardly to abut the height adjustment screw 46.

Modified carriage 41 further includes wheels 39 and 40 to engage the respective top and bottom surfaces of base 12 as described above with respect to carriage 24.

Figure 5:
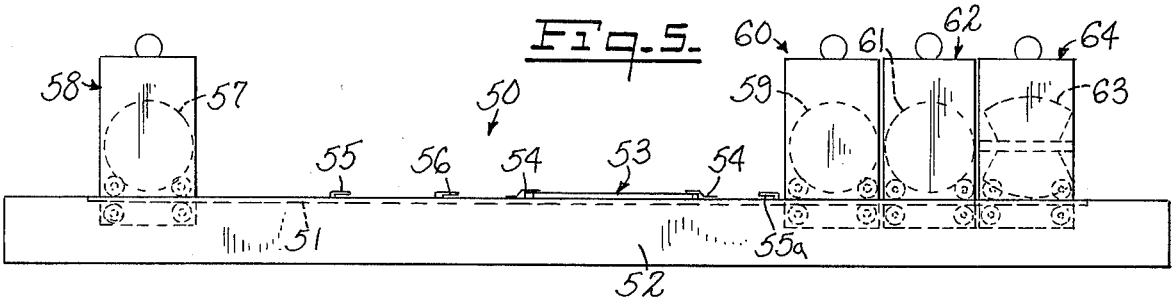
FIG. 5 shows a modification of the printing apparatus shown in FIGS. 1 and 2.

A modified printer 50 as shown in FIG. 5 includes a base 51, a support 52, a card retainer 53 having two pockets (not shown) and two retainer clips 54 on opposite sides of retainer 53. Standard business form retainers 55 and **55*a* are also provided and a small business form retainer 56, which in conjunction with retainer 55*a* holds small business forms suitable for recording only from one of the pockets of retainer 53**, are also provided.

Modified printer 50 further includes an inking roller 57 and carriage 58 and a platen roller 59 and carriage therefor 60. Either carriages 58 or 60 may comprise either of the carriages described with reference to FIGS. 3 and 4.

Modified printer 50 further includes a cleaning roller 61 and carriage 62 therefor and a sponge 63 and a carriage 64 therefor. A cleaning roller 61 is preferably a porous resilient roller carrying a solvent to dissolve residual ink left on the credit and identification cards after the printing operation as described hereinbelow. Sponge 63 is then used for removing the dissolved ink and solvent from the face of the cards. Carriage 62 may be either of the carriages discussed above with reference to FIGS. 3 and 4.

Figure 6:
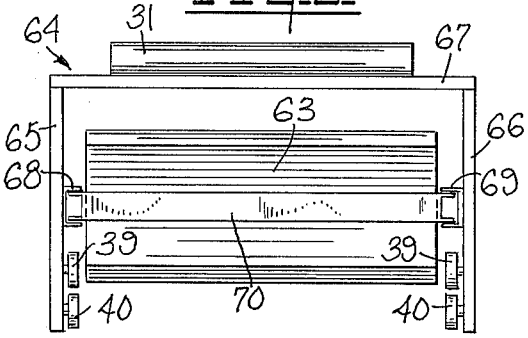
FIG. 6 shows a detail of the rightwardmost carriage as shown in FIG. 5.
Figure 7:
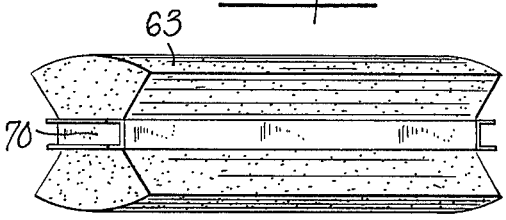
FIG. 7 shows a perspective view of the element carried by the carriage shown in FIG. 6.

With reference to FIG. 6, carriage 64 comprises two vertical members 65 and 66 and a horizontal member 67 therebetween. A pair of channel-shaped members 68 and 69 extend horizontally along the juxtaposed faces of the respective vertical members 65 and 66. Carriage 64 further includes a handle 31 and wheels 39 and 40 for engagement with slots 14. The sponge 63 is non-rotatably supported by carriage 64, a sponge retainer 70 being frictionally engaged by channel members 68 and 69.

Figure 8:
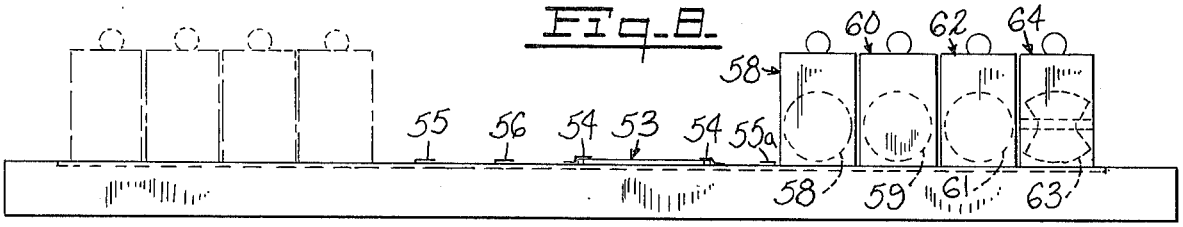
FIG. 8 shows a front elevational view of the apparatus shown in FIG. 5 with all four carriages in a home position, the carriages being shown in the finished position in phantom lines.

With reference to FIG. 8, a second modified printer is shown in which track 14 has sufficient length to allow all four carriages on the home position of card retainers 53 prior to printing, as shown in solid lines in FIG. 8.

Figure 9:
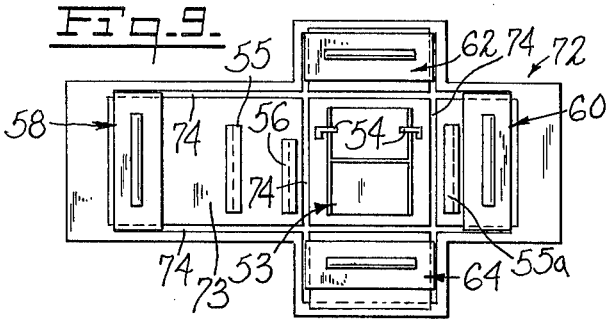
FIG. 9 shows a modification of the device shown in FIG. 5 wherein the cleaning carriages are disposed in a track orthogonal to the inking and printing carriages.

With reference to FIG. 9, a third modified printer 72 is shown. Modified printer 72 comprises a base 73 and slots 74 forming tracks at right angles to each other. With respect to modified printer 72, inking roller carriage 58 and platen carriage 60 traverse the track shown as going from left to right in FIG. 9, whereas the cleaning roller carriage 62 and sponge carriage 64 traverse the vertically disposed tracks as shown in FIG. 9.

It should be understood that carriages 58, 60, 62 and 64 may each ride in either of the vertically — or horizontally — disposed tracks 74 as shown in FIG. 9. The particular carriage arrangement shown in FIG. 9 is for illustrative purposes only.

Printer operation will now be described. With reference to FIG. 1, an identification card is inserted into pocket 17 and a conventional credit card is placed in pocket 16, slipped under retainer clips 18. Carriage 24 is drawn across the cards several times to coat the embossed indicia with ink, after which the carriage 24 is drawn to the left as shown in FIG. 1. A business form is inserted into the retainer clips 19 and **19*a*, or clips 19 and 20 if a small form is to be used. After the business form is inserted into the proper clips, platen carriage 23** is drawn across the upper surface of the form, pressing the form against the inked embossed indicia, transferring ink therefrom to the form. The form is then removed and the customer may be given his receipt. The cards are then removed from the respective pockets and returned to the user.

With reference to FIGS. 5, 8 and 9, the form is printed as discussed with reference to FIG. 1, after which cleaning carriage 62 is drawn across the face of the inked cards causing any residual ink left on the indicia following printing to be dissolved. Carriage 64 is then drawn across the face of the cards several times to wipe the dissolved ink and solvent from the face thereof.

It can be seen that the invention provides an efficient means for identifying the authorized card user and for recording the user's identifying indicia, and particularly his picture or thumbprint on the business form receipt. By providing a picture record of the user on the receipt, it is possible to determine at a later date whether the user was authorized, assuming the indentification card matched the user. Or the store clerk can, on the basis of discrepancy between the appearance of the user and the identifying indicia recorded on the identification card, determine whether the user is the actual person authorized to use the card.

Having described the preferred embodiment of this invention, it will occur to those skilled in the art that various other modifications may be made without departing from the scope of the invention. It is expressly understood that the scope of the invention is not limited to the embodiments and modifications disclosed herein but only as indicated in the appended claims.

What is claimed is:

1. Apparatus for printing onto a business form from either one of an embossed credit card and an embossed identification card, or both cards simultaneously, comprising base means including means for retaining the credit card, means for retaining the identification card, first means for retaining a business form over the embossed indicia on both of the cards, second means for retaining a business form over the embossed indicia on one of the cards, and track means formed in said base means, inking means riding in said track means adapted to ink the embossed indicia on both the credit card and the identification card, platen means riding in said track means adapted to be drawn across the business form to cause the inked indicia to print onto said business form, cleaning means riding in said track means adapted to carry a solvent to dissolve residual ink left on said indicia on both said cards after printing, and non-rotatable wiper means riding in said track means for wiping said dissolved ink from said indicia.

2. Apparatus as defined in claim 1 wherein said track means comprises a first portion and a second portion substantially orthogonal thereto, said inking means and said platen means riding in said first portion and said cleaning means and said wiper means riding in said second portion.

3. Apparatus as defined in claim 1 wherein said wiper means comprises a resilient sponge material non-rotatably held in a carriage by a retainer, said carriage comprising a horizontal top member having depending therefrom two side members having members for non-rotatably engaging said sponge retainer, and further including means for engaging said track means.

4. Apparatus as defined in claim 1 wherein said linking means, said platen means, and said cleaning means each comprise a roller of a resilient material rotatably supported by a carriage.

5. Apparatus as defined in claim 4 wherein at least one of said carriages comprises a horizontal member having depending therefrom two side members, each side member having a lower edge adapted to engage said track means, the roller supported by said one of said carriages being axially supported at each end thereof by a T-shaped member, members depending downwardly from said horizontal member guidingly supporting the horizontal portions of said T-shaped members at both ends thereof, and adjustable height determining means in cooperable relationship with said horizontal member against which said T-shaped member is forced upwardly to abut.

6. Apparatus as defined in claim 4 wherein at least one of said carriages comprises a horizontal member having depending therefrom two side members, each side member having a lower edge adapted to engage said track means, each side member further having a vertically-directed elongated slot formed therein, the roller supported by said one of said carriages having an axle engaging both of said slots, said roller being situated between said side members, said axle being forced upwardly by resilient members in each slot, and adjustable height determining means in cooperable relationship with said horizontal member against which said axle is forced to abut.

* * * * *

UNITED STATES PATENT AND TRADEMARK OFFICE

CERTIFICATE OF CORRECTION

PATENT NO. : 4,083,302

DATED : April 11, 1978

INVENTOR(S) : Ralph R. Bello and Vera C. Bello

It is certified that error appears in the above-identified patent and that said Letters Patent are hereby corrected as shown below:

Column 6, line 3 (claim 4, line 1), change "link-" to --ink- --.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*